US005370504A

United States Patent [19]

Nagashima

[11] Patent Number: 5,370,504

[45] Date of Patent: Dec. 6, 1994

[54] AMBULANT RECIPROCATING COMPRESSOR HAVING PLURAL PRESSURE COLLECTION CHAMBERS

[75] Inventor: Akira Nagashima, Tokyo, Japan

[73] Assignee: Kioritz Corporation, Tokyo, Japan

[21] Appl. No.: 135,296

[22] Filed: Oct. 12, 1993

Related U.S. Application Data

[63] Continuation-in-part of Ser. No. 901,399, Jun. 19, 1992.

[30] Foreign Application Priority Data

| | | | |
|---|---|---|---|
| Jun. 28, 1991 | [JP] | Japan | 3-58303[U] |
| Jun. 28, 1991 | [JP] | Japan | 3-58304[U] |
| Jun. 28, 1991 | [JP] | Japan | 3-58305[U] |
| Jun. 19, 1992 | [JP] | Japan | 4-185319 |

[51] Int. Cl.[5] ..... F04B 21/04; F04B 11/00

[52] U.S. Cl. ..... 417/234; 417/523; 417/540; 417/567; 74/49

[58] Field of Search ..... 417/234, 521, 523, 540, 417/567, 902; 123/56 BC; 74/49

[56] References Cited

U.S. PATENT DOCUMENTS

| | | | |
|---|---|---|---|
| 591,137 | 10/1987 | Miles | 417/523 |
| 951,529 | 3/1910 | Hemenway | 417/540 |
| 1,654,893 | 1/1928 | Meyers et al. | 417/523 |
| 2,733,664 | 2/1956 | Saalfrank | 417/568 |
| 4,842,492 | 6/1989 | Gannaway | 417/540 |

FOREIGN PATENT DOCUMENTS

| | | | |
|---|---|---|---|
| 61074 | 6/1943 | Denmark | 417/521 |
| 665151 | 12/1928 | France | 417/234 |
| 2187258 | 9/1987 | United Kingdom | 417/234 |

*Primary Examiner*—Richard A. Bertsch
*Assistant Examiner*—Roland G. McAndrews, Jr.
*Attorney, Agent, or Firm*—Bauer & Schaffer

[57] ABSTRACT

A pair of oppositely directed pistons are reciprocatingly mounted in a cylinder. The cylinder is formed unilaterally with and encapsulated within a tank for receiving compressed air and has an exhaust port at each end and a valve for controlling the flow of air into the tank. Each piston has a head with an aperture and a unidirectional valve for controlling air flow into the cylinder. An air inlet to the cylinder is located between the piston heads. A motor has a drive shaft extending through the air inlet and a transmission connected to the pistons drives the pistons synchronously in opposing, reciprocating strokes.

3 Claims, 7 Drawing Sheets

AMBULANT RECIPROCATING COMPRESSOR HAVING PLURAL PRESSURE COLLECTION CHAMBERS

RELATED APPLICATIONS

The present application is a continuation-in-part of copending application Ser. No. 07/901,399, filed Jun. 19, 1992, for which priority under 35 U.S.C. 120 is hereby made.

BACKGROUND OF INVENTION

This invention relates to a reciprocating compressor for the compression of gaseous fluids such air, coolants and the like.

Heretofore, reciprocating air compressors, carried out compression by the reciprocating movement of a piston within a cylinder which has an intake aperture and an exhaust aperture. The compressed air is fed into an air reservoir tank installed as a separate body through piping from the exhaust aperture of the cylinder.

However, reciprocating compressors with the conventional structure have their cylinders essentially exposed to the exterior and have numerous parts and pipings, similarly exposed. Consequently highly annoying noises and vibrations are produced which can not be avoided.

It is an object of this invention to provide a reciprocating compressor that is compact by making several of its parts have common functions.

Another object of this invention is to provide a reciprocating compressor of low noise and little vibration.

SUMMARY OF THE INVENTION

To achieve these objects, the present invention is structured so that the cylinder is covered by a tank and is constructed unitarily with the reservoir tank.

Furthermore, an air collection chamber is installed between the exhaust aperture of the cylinder and the tank which is airtight with respect to the cylinder and which is also connected with the interior of the cylinder through an exhaust leaf valve.

As described above, the present invention can collect the compressed air exhausted from the cylinder directly into the reservoir tank because the cylinder, structured unitarily with the tank, projects into the interior of the tank. For this reasons, piping from the cylinder to the tank is not needed and the entire compressor is made more compact. Moreover, less noise is produced.

Also, the air collection chamber is, on one hand, airtight against the tank, but on the other hand, is not perfectly airtight against the cylinder because it is partitioned off from the interior of the cylinder by an exhaust leaf valve. For this reason, the air collection chamber acts as an automatic unloader, so that in case the apparatus is re-started from a standstill position it will prevent the internal pressure of the cylinder from becoming too high and the piston from becoming non-startable.

DETAILED DESCRIPTION OF THE INVENTION

Figure 3:
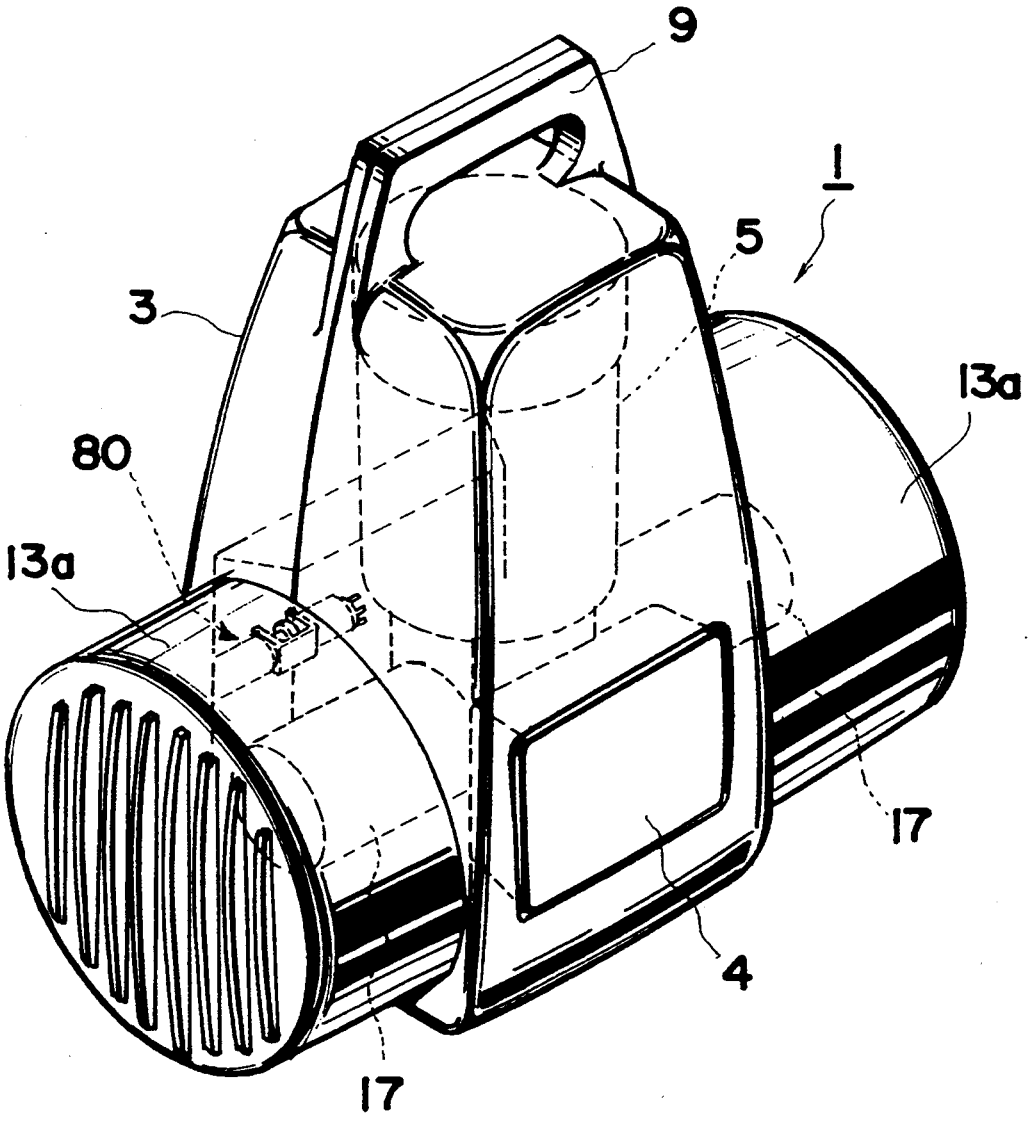
FIG. 3 is a perspective view showing the compressor of the present invention.

Turning first to FIG. 3, the compressor, generally depicted by the numeral 1 comprises a two-part cover 3 formed of front and back members which are removably joined together in use, and which are provided with exterior carrying handles 9. Located within upper part of the cover 3 is a motor 5 and a condenser 7 for the start up of the motor 5.

Figure 1:
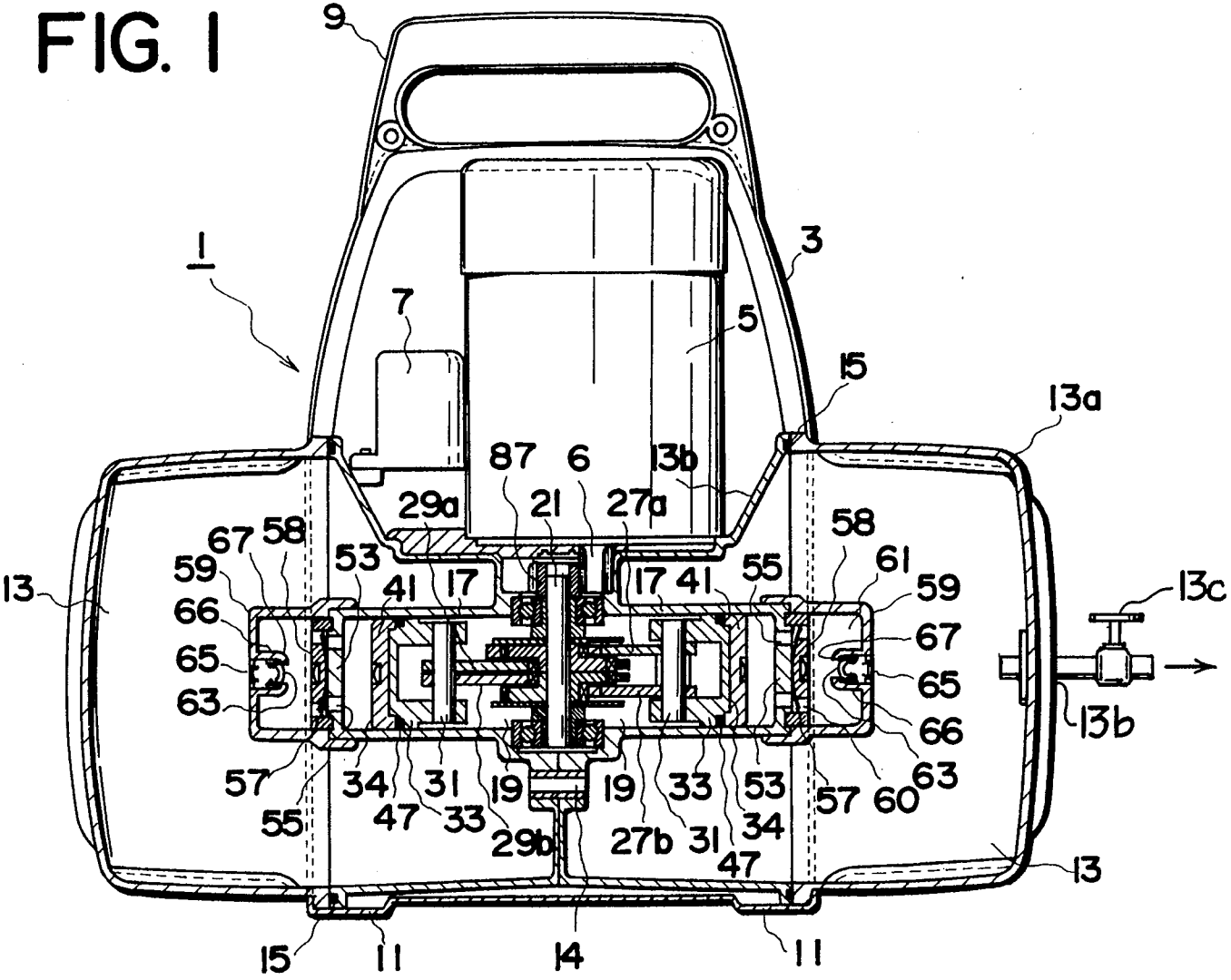
FIG. 1 is a vertically sectioned side view showing an embodiment of a compressor of the present invention.
Figure 2:
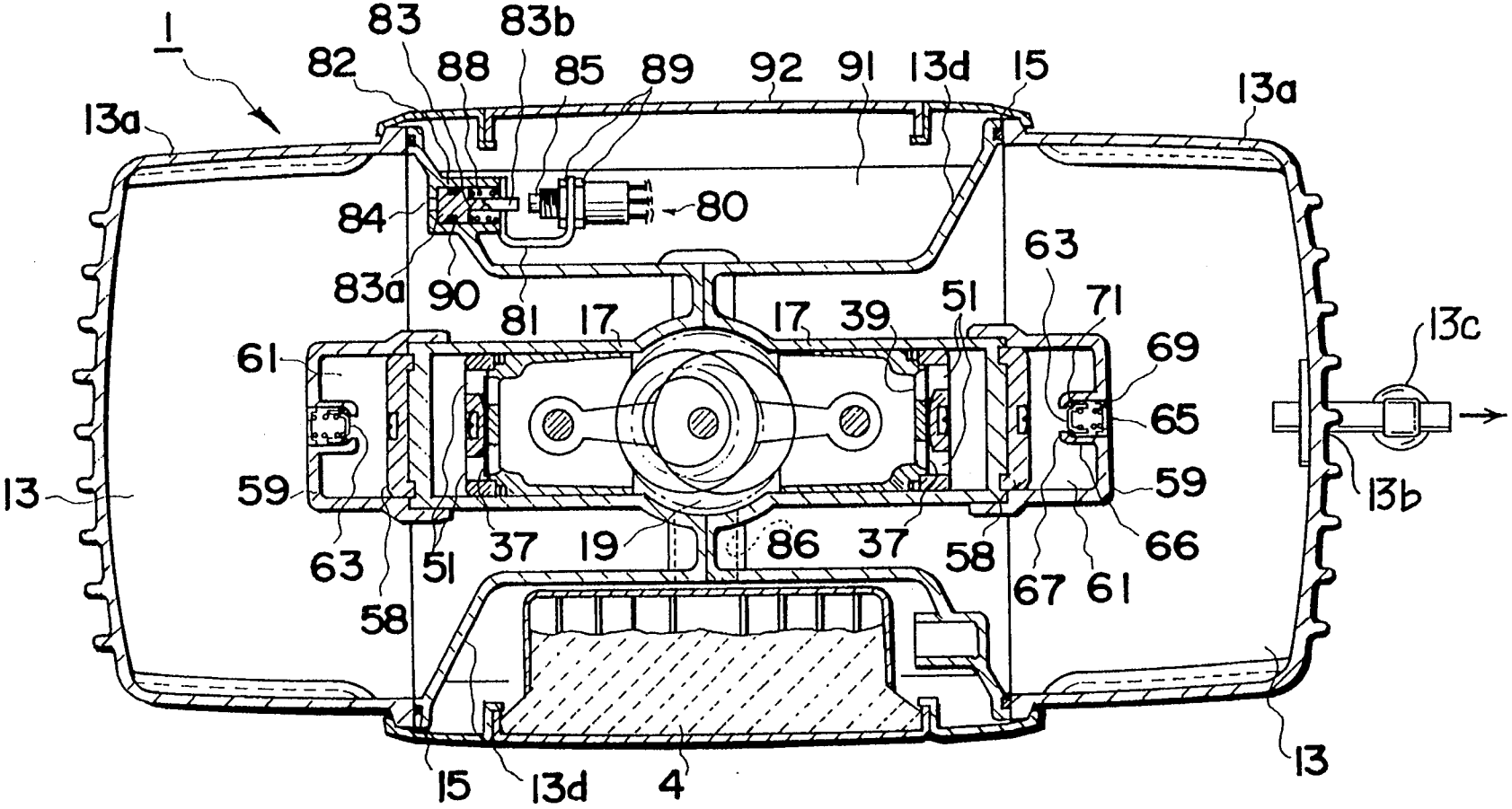
FIG. 2 is a horizontal cross sectional view showing the embodiment of FIG. 1 of a compressor of the present invention.

As seen in detail in FIGS. 1 and 2, the lower part of the cover 3 defines a hollow air tank 13 which is divided into right and left sections of equal capacity facing each other. The right and left sections of the air tank 13 are enlarged by hollow cylindrical members 13*a* which extend respectively orthogonally to the, cover 3. The tank 13 is provided with an outlet 13*b* in which is located a valve 13*c* so that selected use of the compressed gas media may be made. The cylindrical members 13*a* are hermetically joined to the two-part cover 3 through a seal ring 15 so as to form one body. Disposed in the center of the air tank 13 is an elongated compression cylinder 17 which is formed also of left and right parts. The parts of the cylinder 17 are unitarily formed with brackets 13*d* which also form the side walls of air tank 13. In the embodiment shown in the drawings, for the sake of convenience in manufacturing the machine, the cylinder 17 is installed concentrically with the air tank 13, but it is not limited thereto.

The sections of the air tank 13 are joined back to back so that the tubular center of the cylinder 17 correspond therewith and are mutually fixed by appropriate means such as by bolts and the like. The interior of each section of the air tank 13 communicates via the passageway 14 through the wall brackets 13*d*.

The bases of each of the parts of the cylinder 17 are combined with each other to form a crank chamber 19. Air that has been cleaned by an air cleaner 4 installed on the side of the cover 3 is fed to the crank chamber 19 through an intake passageway 86 formed in the contact surfaces of the left and right parts of the cylinder 17 via a suitable unidirectional valve (not shown in the drawings) located in passageway 86 preventing back flow of the air through the air cleaner 4.

The motor 5 is provided with a motor shaft 6 depending into engagement with a parallel crank shaft 21, through a gear 87. The crank shaft 21 is journalled to rotate freely between the contact surfaces of the parts of the cylinder 17. Therefore, the cylinder 17, and the air tank 13, are perfectly symmetrical, right and left, with respect to the crank shaft 21 in shape and also in capacity.

Figure 4:
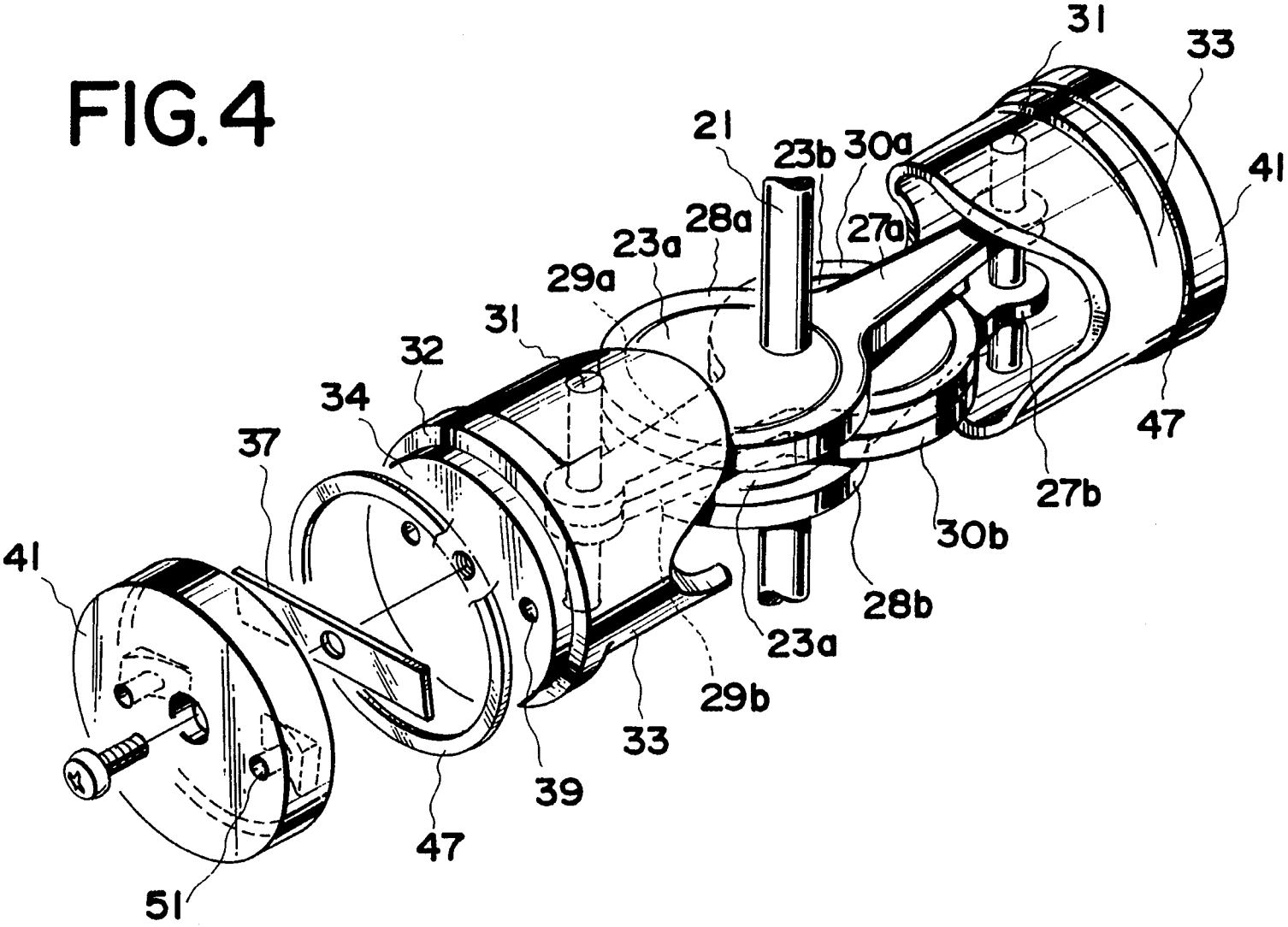
FIG. 4 is an exploded view showing the interior construction of the crank chamber.

As seen in FIG. 4 the crank shaft 21 has attached to it the central eccentric cams disks 23*a* and 23*b* of two pair of cranks. The left pair of disks 23*a* are sandwiched between the disks 23*b* of the right hand crank which are joined together, one laying on top of the other. Each pair of the crank disks 23*a* and 23*b* are arranged off-center with respect to each other.

About the periphery of each of the disks 23*a* and 23*b* there is journalled, by suitable ball bearings, a ring 28*a* and 28*b* respectively. Extending outwardly from each ring is piston rod 27*a* and 27*b* respectively connected to a piston pin 31 secured to a piston 33 extending to the left and right sides of the cylinder in opposition to each other.

Both the left and right pistons 33 being of the same size and function simultaneously perform reciprocating movements in opposite directions to each other with the rotation of the crank shaft 21. Since, as described above, the left and right cylinders 17 and the pistons 33 are all of the same size, a perfect balance is functionally established on the both sides of the crank shaft 21. As a result, the vibrations produced by the working of pistons 33 negate each other, thus greatly reducing overall vibration during the operation.

Figure 5:
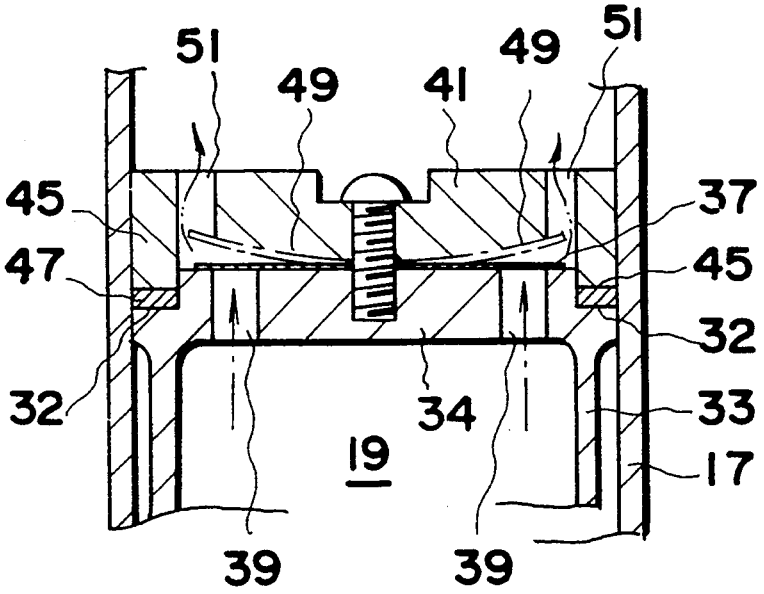
FIG. 5 is a vertically sectioned view of the piston head.

As seen in FIG. 5, each of the pistons 33 are provided with piston heads 34 having apertures 39 diametrically opposed and equidistant from the center of the piston head. The apparatus are covered by the flap ends of an elongated leaf valve 37 clamped at its center to the piston head by a holder 41, fixed by means of a screw to the piston head. This has the advantage in preventing intake noise from leaking out to the exterior. Further, little noise is provided, since leaf valve 37 is provided inside of the cylinder 17, as shown in the drawings. Also, since efficiency in the intake process is good, there is little noise because the direction of the flow of the media being compressed is not reversed.

As seen in FIG. 5 the valve holder 41 is disk shaped having a substantially identical diameter with that of the piston head 34 and is surrounded by a ring 45. The ring 45 conforms to and seats in a step 32 which is provided on the outer edge of the piston head 34. Between the ring 45 and the step 32 there is interposed a seal ring 47.

The back surface of each of the intake valve holders 41 (the surface facing the piston head 34), is formed with a pair of recesses 49 having a smoothly arching inclined planes from the center outwardly against which the flap ends of the intake leaf valves 37 abut when in an open condition. That is, each of the inclined bottoms 49 limit the degree of opening of each of the leaf valves 37.

Extending through the intake valve holder 41 are two apertures 51 which are located diametrically outside of the intake aperture so that when the leaf valves 37 are in an open condition the apertures 39 will not be closed by their flap ends of the leaf valves. As a result, when the piston 33 moves from the top dead center to the bottom dead center, the intake leaf valves 37 open and air in the crank chamber 19 is sucked into the cylinder 17 through the intake apertures 39 and 51.

Figure 6:
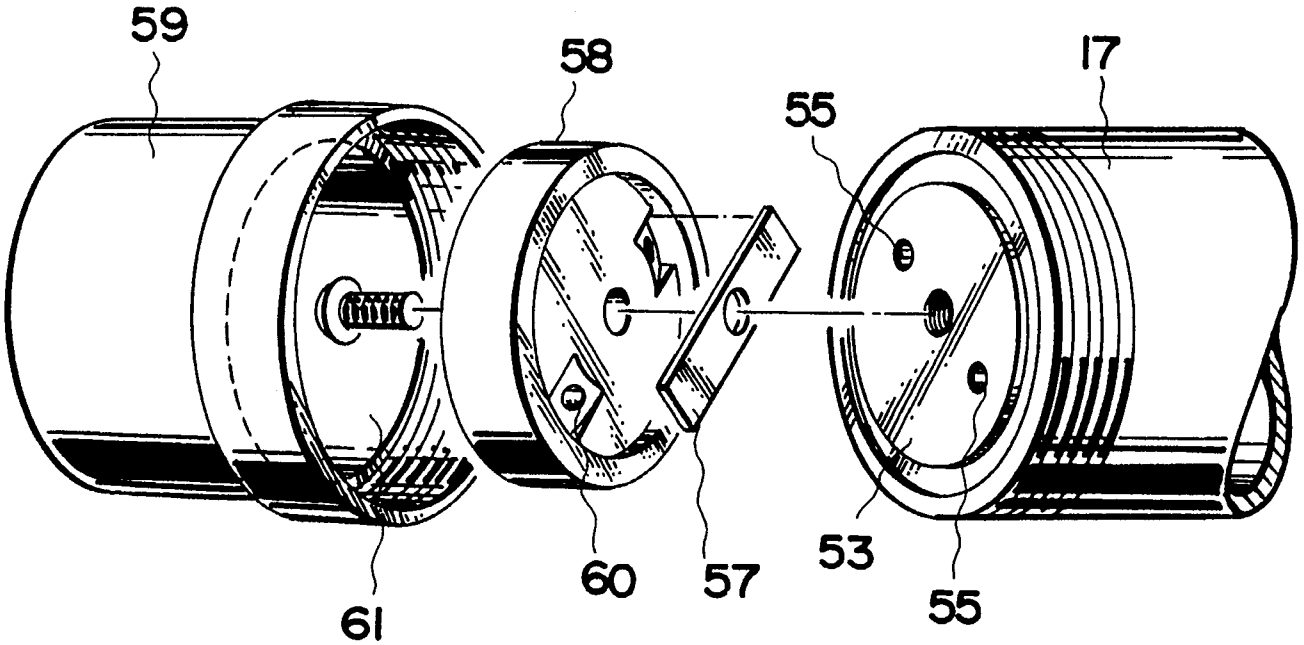
FIG. 6 is an exploded view of the cylinder head.

As seen in FIG. 6 each end of the cylinder 17 is provided with a head 53 in which two exhaust apertures 55 are provided. Each cylinder head 53 is provided with exhaust leaf valves 57 which are identical in construction with the intake leaf valves 37 and which are installed to cover exhaust apertures 55. The exhaust leaf valves 57 are fixed with screws to the cylinder head 53, together with an exhaust valve holder 58 which is constructed identically with the intake valve holder 41. In the embodiment shown in the drawings, the exhaust valve holder 58 and each of the intake valve holders 41 are attached at a position that has been rotated 90 degrees to each other.

A cover 59 is attached over the head 53 so that an air collection chamber 61 is formed between the inner surfaces of the cover 59 and the upper surface of the exhaust valve holder 58. A check valve 63 is provided at the top end of the cover 59 permitting the expulsion of air from the air collection chambers 61 to the air tanks 13 when the air pressure in the air collection chambers 61 exceeds a preset pressure, while also preventing the leakage of air from the air tank 13 back into the air collection chamber 61.

The check valve 63 is set in an outlet aperture 65 on the top of each of the covers 59, which also provides a tubular portion 66 to project towards the inside of the air collection chambers 61. Each tubular portion has an inwardly turned flange 67, against which the check valve 63 is biased by means of a spring 69. An O-ring 71 is provided for sealing between the valve 63 and the inward turned flange 67.

The provision of the aforementioned formation of the air collection chambers 61 between the exhaust aperture 55 of each of the cylinder 17 and the air tank 13 is for the following reason:

The exhaust leaf valves 57 provided on the cylinder heads 53 are not made with very good sealing properties, consequently when the operation of the pistons 33 are stopped there is a possibility that the compressed air in the air collecting chambers 61 will naturally leak into the cylinder 17. Heretofore this created a problem in that the inner pressure in the cylinder 17 will rise too high and the pistons 33 will not start up at the time of restarting. Thus, the air collection chambers 61 were provided in order to prevent this problem.

Figure 7:
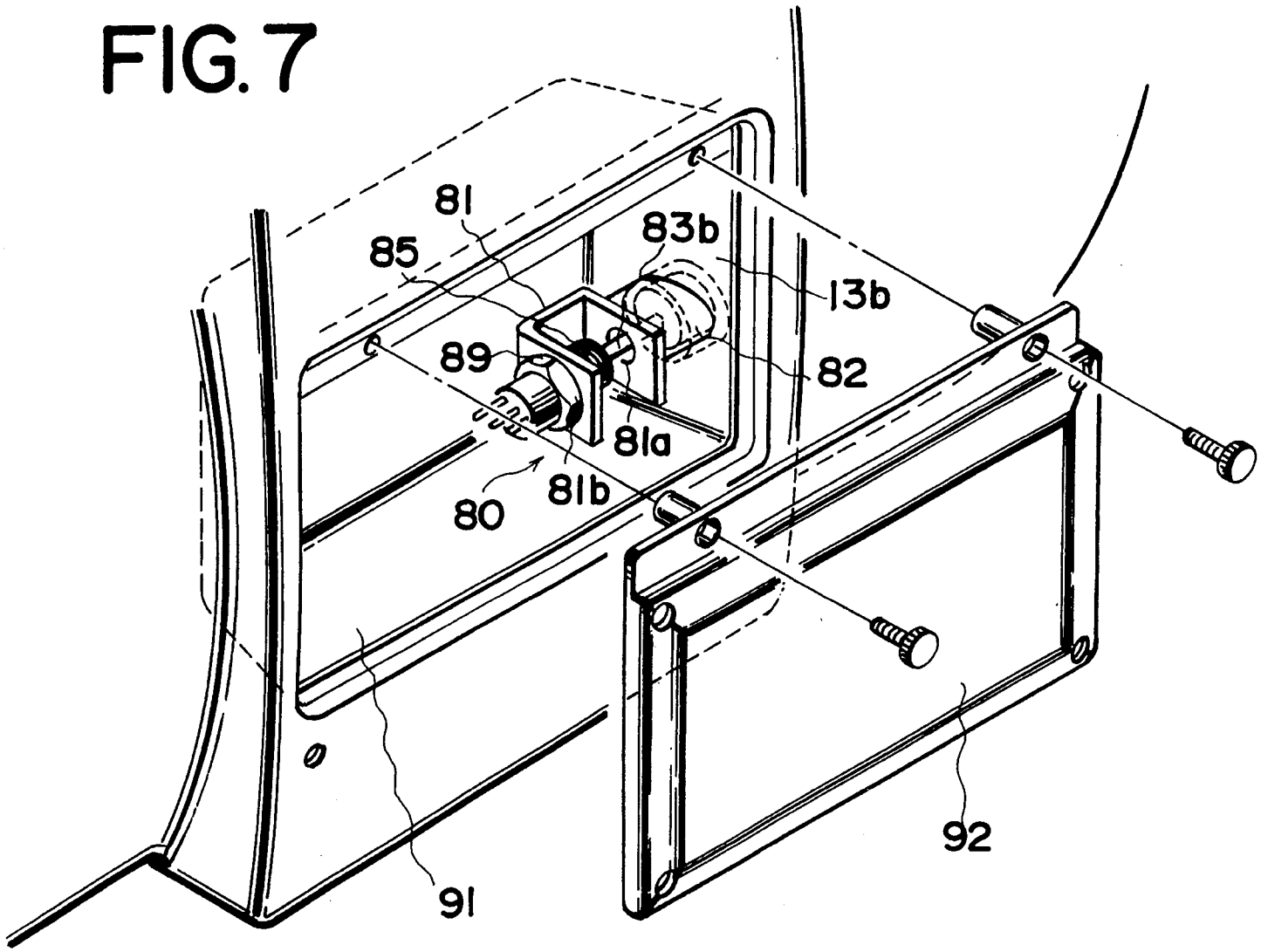
FIG. 7 is an exploded view of a pressure control switch.

Referring to FIG. 2, on the opposite side of the air cleaner 4, there is provided a pressure control switch 80 for regulating the air pressure of the compressed air produced by the compressor 1. As seen in detail in FIG. 7, first a cylinder 82 is provided to project out of the side of he air tank 13. This cylinder 82 is formed to be unitary with the bracket 13*d* air tank through an aperture 84 (FIG. 2). The cylinder 82 is disposed in a cavity 91 which is covered by a removable cover plate 92 provided on the side of the air tank 13 which also encloses the compressor 1 compactly. A pressure detecting rod 83 consisting of a head 83*a* and a shaft 83*b* is inserted in the cylinder 82 and the head 83*a* of the pressure detecting rod 83 is sealed by a ring 90 so that airtightness is maintained. A U-shaped holder 81 is fixed on one leg to the outer end of the cylinder 82 and is provided with an aperture 81*a* through which the shaft 83*b* passes. A button switch 85 is mounted on the other leg in opposition to the pressure detecting rod 83. The shaft 83*b* is biased to the opposite side of the holder 81 by means of a spring 88 that is normally inserted in the cylinder 82. The button switch 85 controls the operation of the motor 5 and is inserted in the holder 81 opposite to the pressure detection rod 83. The button switch 85 has threads at its middle section and is attached to the holder 81 by two adjusting fixture nuts 89, so that it is freely adjustable in the direction of pressure detecting rod 83 by turning and adjusting the adjusting fixture nuts 89. The pressure control switch 80 acts as follows: Together with a change of pressure in the air tank 13, the degree by which the pressure detecting rod 83 projects outward from the holder 81 changes continuously. When the end of the pressure detecting rod 83 presses against the button switch 85, the working of the motor 5 is stopped. The space between the button switch 85 and the pressure detecting rod 83 can be suitably determined by adjusting the amount of initial projection of the detecting rod 83 toward the switch 85.

Therefore, the air pressure of compressed air can easily be controlled.

First of all, the air that has been cleaned through the air cleaner 4 and supplied to the crank chamber 19 is sucked into each section of the cylinder 17 by the pistons 33 driven by the motor 5. That is, by the simultaneous movement of the pair of the left and right pistons 33 sequentially and alternatingly from the top dead center to the bottom dead center, the intake leaf valves 37 which have been provided on the piston heads 34 are opened and air is sucked into the cylinder 17 via the respective intake apertures 39 and 51. At this time, the exhaust leaf valves 57 that have been provided on cylinder heads 53 are in closed condition. After reaching bottom dead center and the pistons 33 begin to move toward the top dead center, each of the intake leaf valves 37 are in closed condition. On the other hand, the exhaust leaf valves 57 are in an open condition due to a rise in pressure in the cylinder 17. Therefore, the air expelled into cylinder 17 will be forced into the respective air collection chamber 61 via the exhaust apertures 55 and 60.

When the pressure in the air collection chambers 61 becomes higher than the preset level determined by the pressure control, the compressed air in the air collection chambers 61 will cause the check valves 63 to open and allow the air to flow into the air tanks 13. The air in the air tanks 13 will not flow back into the air collection chambers 61 because of the action of the check valves 63.

With a change in pressure in the air tank 13, the projection of the detecting rod 83 will correspondingly change when the tip of the pressure detecting rod 83 presses against the button switch 85, the operation of the motor 5 will be stopped.

According to the present invention, the number of parts are few and inexpensive because the cylinder 17 and the tanks 13 constitute one body. Also, there is little noise produced by vibration because there is no piping and the fittings and attachments for the compressor are all installed inside the body. Further advantages arise because of the compactness of the whole apparatus and good appearance because the tank has been incorporated in the compressor.

Also, because the intake valve is provided on the interior of the cylinder, the leakage of intake noise to the outside is prevented. Also intake and exhaust efficiency is high because the direction of air movement does not reverse itself in the intake process or in the exhaust process.

Furthermore, because a perfect balance is functionally established on both the left and right sides of the crank shaft, the vibration generated by the movement of the pistons will neutralize each other and the vibration generated by the whole compressor will be drastically reduced.

Moreover, because all the parts operating on both the left and right sides with the crank shaft in the center have common usages, they have the advantage of benefiting from mass production and keeping low costs.

Also, the compressor of the construction under the present invention is especially suitable for the intermittent use of such as for nursing bed lifting apparatus use and for use in small volume amounts where the generation of heat is not a serious problem.

What is claimed is:

1. A reciprocating compressor comprising a cylinder having a pair of oppositely directed pistons reciprocatingly mounted therein, said cylinder being formed unilaterally with and encapsulated within a tank defining a sealed chamber for receiving compressed air, a collection chamber interposed between said cylinder and said tank, said cylinder having an exhaust port at each end and valve means for controlling the flow of air from said cylinder to said collection chamber, and said collection chamber having a valve for controlling and balancing the flow of compressed air to said tank, each of said pistons having a head provided with an aperture and a unidirectional valve for controlling air flow into said cylinder, and an air inlet located between said piston heads for permitting the flow of air to said pistons, said pistons being similarly constructed and symmetrically located within said cylinder and drive means, comprising a motor having a shaft extending through said air inlet chamber and transmission means connected to each of said pistons to synchronously drive said pistons in opposing, reciprocating strokes.

2. The compressor according to claim 1, wherein said exhaust port from said cylinder comprises a leaf valve for unidirectionally controlling the flow of air from said cylinder into said collection chamber interposed between said exhaust port and said tank, said leaf valve being sealed against flow of air from said tank to said cylinder.

3. The compressor according to claim 1, wherein said air inlet comprises a chamber communicating with said cylinder and an intake port on the head of said piston having a leaf valve to unidirectionally control the flow of air into said cylinder from said air inlet chamber.

* * * * *